United States Patent [19]

Johnson

[11] 4,007,107

[45] Feb. 8, 1977

[54] ELECTROLYTIC ANODE

[75] Inventor: Harlan B. Johnson, Rittman, Ohio

[73] Assignee: PPG Industries, Inc., Pittsburgh, Pa.

[22] Filed: Oct. 18, 1974

[21] Appl. No.: 515,938

[52] U.S. Cl. ..... 204/290 F; 204/292; 204/293

[51] Int. Cl.[2] ..... C25B 11/06; C25B 11/10

[58] Field of Search ..... 204/290 R, 290 F, 292, 204/293

[56] References Cited

UNITED STATES PATENTS

| | | | |
|---|---|---|---|
| 3,293,167 | 12/1966 | Greenspan | 204/290 F |
| 3,340,097 | 9/1967 | Hess et al. | 204/290 F |
| 3,428,544 | 2/1969 | Bianchi et al. | 204/290 F |
| 3,441,495 | 4/1969 | Colman | 204/268 |
| 3,449,231 | 6/1969 | Adams et al. | 204/195 |
| 3,491,014 | 1/1970 | Bianchi et al. | 204/242 |
| 3,852,175 | 12/1974 | Hoekje | 204/98 |

FOREIGN PATENTS OR APPLICATIONS

| | | | |
|---|---|---|---|
| 892,720 | 5/1944 | France | 20/293 |
| 556,083 | 9/1943 | United Kingdom | 204/293 |

OTHER PUBLICATIONS

Inorganic Chemistry by Heslop, pp. 554, 555, pub. by Elsevieo Pub. Co., New York (1967).

*Primary Examiner*—F.C. Edmundson
*Attorney, Agent, or Firm*—Richard M. Goldman

[57] ABSTRACT

Disclosed is an electrode having an electroconductive substrate and an electroconductive layer on the substrate. The electroconductive layer is an intermetallic compound of a platinum group metal and a transition metal. Also disclosed is a method of electrolyzing brine, such as sodium chloride brine, where the brine is fed to an electrolytic cell having an anode and a cathode, an electrical current is passed from the anode to the cathode, and chlorine is evolved at the anode, which anode has an electroconductive substrate with an electroconductive layer thereon formed by an intermetallic compound of a platinum group metal and a transition metal. The electroconductive layer may either be an intermediate layer with a further layer of a catalytic material, as an electrocatalytic material or surface catalytic material, or it may be the catalytic material itself.

2 Claims, No Drawings

ELECTROLYTIC ANODE

BACKGROUND OF THE INVENTION

In the electrolysis of brines to yield chlorine or sodium chlorate, an anode and a cathode are provided within an electrolytic cell. An electrical potential is established between the anode and the cathode whereby the negatively charged chloride ions are attracted to the anode. At the anode, the reaction:

$$Cl \rightarrow Cl + e^-$$

occurs. Thereafter, the monoatomic chlorine atoms, i.e., nascent chlorine, combine to form diatomic chlorine molecules according to the reaction:

$$2Cl \rightarrow Cl_2$$

In chlorine production, the chlorine molecules form gas bubbles on the surface of the anode, and chlorine is subsequently recovered as a gas above the electrolyte. In chlorate production, the neutral to basic pH of the cell causes further oxidation of the chlorine molecules and ultimately results in the formation of chlorate ion, $ClO^-_3$.

In both processes, the anode is subjected to rigorous conditions. For example, the anode is subjected to conditions of attack by nascent chlorine atoms in an acidic media under anodic conditions. This necessitates the use of a particularly corrosion-resistant material for the electrode. However, the electrode material must have electrocatalytic properties for the chlorine evolution reaction and sufficient electroconductivity to permit the passage of electrical current therethrough with a minimum IR voltage drop with an electrode coating thickness sufficient to protect the substrate from the effect of the electrolyte and electrolytical reaction.

SUMMARY OF THE INVENTION

It has now been found that these desirable properties may be provided by an electrode having a suitable electroconductive substrate and a layer of an electroconductive, intermetallic composition of a platinum group metal and a transition metal. The platinum group metals used to provide the intermetallic composition are ruthenium, rhodium, palladium, rhenium, osmium, iridium, and platinum. The transition metals used to provide intermetallic compounds are typically titanium, vanadium, chromium, manganese, iron, cobalt, nickel, zirconium, columbium, molybdenum, hafnium, tantalum, tungsten, tin, and lead. The intermetallic compositions are typically stoichiometric compounds having a unique formula, x-ray diffraction pattern, and physical properties.

DETAILED DESCRIPTION OF THE INVENTION

It has now been found that a particularly desirable anode may be provided by an electroconductive substrate having a layer of an electroconductive intermetallic compound of a platinum group metal and a transition metal thereon. The platinum group metals used in providing the intermetallic composition include ruthenium, rhodium, palladium, rhenium, osmium, iridium, and platinum. The transition metals used to provide the intermetallic composition are titanium, vanadium, chromium, manganese, iron, cobalt, nickel, zirconium, columbium, molybdenum, hafnium, tantalum, tungsten, tin, and lead. Particularly preferred transition metals are the refractory metals, i.e., titanium, vanadium, chromium, zirconium, columbium, molybdenum, tantalum, tungsten, hafnium, and manganese.

The platinum group metal and transition metal of the intermetallic composition are in a stoichiometric relationship. That is, the platinum group metal and the transition metal are in a small whole number molar ratio to each other in the intermetallic compositions. Most generally they are in a ratio of from about 1 to about 7 atoms of the precious metal to about 1 to about 7 atoms of the transition metal and generally from about 1 to about 3, 4, or 5 atoms of the precious metal to about 1 to about 3, 4, or 5 atoms of the transition metal. Additionally, stoichiometric relationships may be determined by x-ray diffraction patterns occurring within a narrow vicinity of a small whole number mole ratio. According to the metallurgical literature, this is indicative of a unique crystal structure in the vicinity of the small whole number mole ratio.

Furthermore, the intermetallic compositions useful in providing the electrode material of this invention are characterized by a local maximum or minimum of physical and physicochemical properties with respect to composition. For example, the melting point may be a maximum such as a congruent melting composition or a minimum such as a eutectic composition. Additionally, within the narrow range of stoichiometric compositions herein contemplated, the electroconductivity may be a relative maximum with respect to composition. The hardness and impact strength may also be relative maximums with respect to composition. Furthermore, upon microscopic examination, for example, by polishing a surface of a casting of a material and etching the polished surface in a suitable acid or other reagent, the substantial presence of only a single metallographic phase may be detected. Additionally, a congruent solid phase transformation, such as a peritectoid, may be the composition within the narrow stoichiometric compositions herein contemplated.

The small whole number molar ratio stoichiometry, the unique x-ray diffraction patterns, the local extrema of physical and physicochemical properties, and the presence of only a single metallographic phase, either singly or in combination, give rise to the characterization of the intermetallic compositions as being intermetallic compounds. Whenever the term "intermetallic compound" is used herein, it will be understood to refer to an intermetallic composition characterized by at least some of the following properties: a small whole number molar ratio of the precious metal and transition metal, a unique x-ray diffraction pattern within a narrow range of the small whole number molar ratio, local extrema of physical and physicochemical properties within a narrow range of the small whole number molar ratio, and the presence of only a single matallographic phase.

The intermetallic compositions useful in providing the anodic materials herein contemplated have the formula:

$$M'_A M''_B$$

where M′ may be ruthenium, rhodium, palladium, osmium, iridium, platinum, and rhenium; M″ may be titanium, vanadium, zirconium, niobium, columbium, molybdenum, tantalum, tungsten, iron, chromium, nickel, manganese, tin, and lead; A is from 1 to about 7; and B is from about 1 to about 7.

Typical ruthenium compounds useful in providing the electrode material of this invention include RuTi, RuV, $Ru_2Zr$, NbRu, $Mo_5Ru_3$, RuTa, $W_3Ru_2$, $RuCr_2$, and $Sn_2Ru$. Typical rhodium compositions useful in providing the electrode material of this invention include $Rh_3Ti$, $Rh_3V$, $Rh_3Zr$, $Rh_3Nb$, $Rh_3Ta$, $RhCr_3$, $Rh_3Sn$, and $Rh_3Pb_2$. Typical palladium compositions useful in providing the electrode material of this invention include $TiPd_3$, $Pd_3V$, $Pd_3Zr$, PdTa, $FePd_3$, $Pd_3Mn_2$, $PdSn_3$, and $Pd_3Pb$. Typical osmium compositions useful in providing the electrode material of this invention include OsTi, OsV, OsZr, $Nb_3Os_2$, $Mo_{19.5}Os_{10.5}$, $Ta_3Os$, $WOs_2$, and $Cr_2Os$. Typical iridium compositions useful in providing the electrode material of this invention include $TiIr_3$, $VIr_3$, $ZrIr_2$, $Ir_3Nb$, $Mo_3Ir$, $TaIr_3$, HfIrNi, $Cr_3Ir$, $Mn_3Ir$, and $IrSn_2$. Typical platinum compositions useful in providing the electrode composition of this invention include $Pt_3Ti$, $Pt_3V$, $Pt_3Zr$, $Pt_3Nb$, $Pt_3Mo$, $Pt_4Ta$, $Pt_3Fe$, $PtCr_2$, $Pt_2Sn_3$, $PbPt_5$, $PbPt_6$, and $PbPt_7$. Typical rhenium compositions useful in providing the electrode material of this invention include $Ti_{.9}Re_{.1}Si_2$, $Re_3V$, $Re_2Zr$, NbRe, MoRe, TaRe, WRe, $Re_3Fe_2$, $Re_6Co_{5.7}Si_{1.3}$, CrRe, and $Mn_3Re_2$. The particulaly preferred compositions are the compositions containing titanium, tantalum, and molybdenum.

The particularly preferred rhenium compositions include $Ti_{.9}Re_{.1}Si_2$, MoRe, and TaRe. The particularly preferred rhodium compositions include $Rh_3Ti$ and $Rh_3Ta$. The particularly preferred palladium compositions include $TiPd_3$ and PdTa.

The particularly preferred osmium compositions include OsTi, $Mo_{19.5}Os_{10.5}$, and $Ta_3Os$.

The particularly preferred iridium compositions include $TiIr_3$, $Mo_3Ir$, and $TaIr_3$.

The particularly preferred platinum compositions include $Pt_3Ti$, $Pt_3Mo$, and $Pt_4Ta$. Especially preferred compositions are the molybdenum containing compositions $Mo_5Ru_3$, $Mo_{14.5}Os_{10.5}$, $Mo_3Ir$, $Pt_3Mo$, and MoRe.

Typical titanium compositions useful in providing the electrode material of this invention include RuTi, $Rh_3Ti$, $TiPd_3$, OsTi, $TiIr_3$, $Pt_3Ti$, and $Ti_{.9}Re_{.1}Si_2$. Typical vanadium compositions useful in providing the electrode material of this invention include RuV, $Rh_3V$, $Pd_3V$, OsV, $VIr_3$, $Pt_3V$, and $Re_3V$. Typical zirconium compositions useful in providing the electrode material of this invention include $Ru_2Zr$, $Rh_3Zr$, $Pd_3Zr$, OsZr, $ZrIr_2$, $Pt_3Zr$, and $Re_2Zr$. Typical columbium (niobium) compositions useful in providing the electrode material of this invention include NbRu, $Rh_3Nb$, $Nb_3Os_2$, $Ir_3Nb$, $Pt_3Nb$, and NbRe. Typical molybdenum compositions useful in providing the electrode material of this invention include $Mo_5Ru_3$, $Mo_{14.5}Os_{10.5}$, $Mo_3Ir$, $Pt_3Mo$, and MoRe. Typical tantalum compositions useful in providing the electrode materials of this invention include RuTa, $Rh_3Ta$, PdTa, $Ta_3Os$, $TaIr_3$, $Pt_4Ta$, and TaRe. Typical tungsten compositions useful in providing the electrode materials of this invention include $W_3Ru_2$, $WOs_2$, and WRe. Typical iron compositions useful in providing the electrode materials of this invention include $FePd_3$, $Pt_3Fe$, and $Re_3Fe_2$. A nickel composition useful in providing the electrode material of this invention is HfIrNi. Typical chromium compositions useful in providing the electrode materials of this invention include $RuCr_2$, $RhCr_3$, $Cr_2Os$, $Cr_3Ir$, $PtCr_2$, and CrRe. Typical manganese compositions useful in providing the electrode materials of this invention include $Pd_3Mn_2$, $Mn_3Ir$, and $Mn_3Re_2$. Typical tin compositions useful in providing the electrode materials of this invention include $Sn_2Ru$, $Rh_3Sn$, $PdSn_3$, $IrSn_2$, and $Pt_2Sn_3$. Typical lead compositions useful in providing the electrode materials of this invention include $RhPb_2$, $Pd_3Pb$, $PbPt_5$, $PbPt_6$, and $PbPt_7$.

One class of intermetallic compositions useful in providing the electrode materials of this invention are those having a tetragonal crystal habit with a $P_4$ space group. This class of materials includes the intermetallic compositions of molybdenum and ruthenium, $Mo_5Ru_3$, of platinum and columbium, $Pt_3Nb$, of tantalum and osmium, $Ta_3Os$, of chromium and osmium, $Cr_2Os$, and of vanadium, $Re_3V$, niobium, NbRe, tantalum, TaRe, tungsten, WRe, chromium, CrRe, and manganese, MnRe, compounds of rhenium, chromium and iridium, $Cr_3Ir$, and manganese and iridium, $Mn_3Ir$. Typical x-ray diffraction patterns reported in the A.S.T.M. X-Ray Powder Diffraction Files are shown in Tables I through III.

Table I

X-Ray Diffraction Pattern of OsTa

| Interplanar Spacing (d) Angstroms | Intensity ($I/I_1$) |
|---|---|
| 2.586 | 20 |
| 2.400 | 75 |
| 2.335 | 40 |
| 2.235 | 35 |
| 2.179 | 100 |
| 2.129 | 70 |
| 2.082 | 20 |
| 1.393 | 30 |
| 1.380 | 40 |
| 1.354 | 40 |
| 1.342 | 30 |
| 1.318 | 30 |

Table II

X-Ray Diffraction Pattern of $Cr_2Os$

| Interplanar Spacing (d) Angstroms | Intensity ($I/I_1$) |
|---|---|
| 4.13 | 5 |
| 2.472 | 10 |
| 2.358 | 20 |
| 2.217 | 70 |
| 2.151 | 20 |
| 2.092 | 20 |
| 2.037 | 45 |
| 2.002 | 100 |
| 1.954 | 55 |
| 1.899 | 10 |

Table III

X-Ray Diffraction Pattern of $Mo_5Ru_3$

| Interplanar Spacing (d) Angstroms | Intensity ($I/I_1$) |
|---|---|
| 2.58 | 20 |
| 2.48 | 20 |
| 2.32 | 60 |
| 2.26 | 20 |
| 2.21 | 30 |
| 2.10 | 100 |
| 2.05 | 30 |
| 2.00 | 20 |
| 1.91 | 30 |
| 1.61 | 30 |
| 1.44 | 30 |
| 1.37 | 60 |
| 1.34 | 60 |
| 1.31 | 60 |
| 1.27 | 60 |
| 1.25 | 60 |
| 1.23 | 60 |

Table III-continued

X-Ray Diffraction Pattern of $Mo_5Ru_3$

| Interplanar Spacing (d) Angstroms | Intensity ($I/I_1$) |
|---|---|
| 1.17 | 50 |
| 1.16 | 50 |
| 1.15 | 50 |
| 1.13 | 60 |
| 1.09 | 60 |
| 1.07 | 50 |
| 1.05 | 60 |
| 1.02 | 60 |
| 1.00 | 30 |
| 0.06 | 20 |
| .95 | 30 |
| .93 | 50 |
| .92 | 50 |
| .91 | 50 |
| .90 | 70 |
| .88 | 70 |
| .87 | 50 |
| .865 | 50 |
| .860 | 50 |
| .856 | 50 |
| .851 | 30 |
| .846 | 70 |

Table I is the data for $Ta_3Os$ reported by Nevitt and Downey, Trans. AIME, 209, 1057 (1957) and reproduced in A.S.T.M. X-Ray Powder Diffraction File, 10–293. Table II is from the data of Waterstrat and Kasper, J. Metals, 9, 872 (1957), reproduced in A.S.T.M. X-Ray Powder Diffraction File, 9–319, for $Cr_2Os$. Table III is from the data of Raub, Z. Metallkunde, 45, 23 (1954), and Greenfield and Beck, J. Met. 8, 265 (1956), both reported in A.S.T.M. X-Ray Powder Diffraction File, 7–129, for $Mo_5Ru_3$.

Another desirable category of materials are those having a cubic crystal structure with a $P_m3_n$ space group. Included within this category are the compositions of titanium, i.e., rhodium titanium, $Rh_3Ti$, platinum titanium, $Pt_3Ti$, and iridium titanium, $Ir_3Ti$, the compositions of vanadium such as rhodium vanadium, $Rh_3V$, ruthenium vanadium, RuV, iridium vanadium, $Ir_3V$, and osmium vanadium, OsV, the zirconium compounds having a cubic structure rhodium zirconium, $Rh_3Zr$, ruthenium zirconium, RuZr, and osmium zirconium, OsZr. Also included within this category are the compositions of iridium tantalum, $Ir_3Ta$, rhodium tantalum, $Rh_3Ta$, and platinum chromium, $PtCr_2$. Typical x-ray diffraction patterns are shown in Tables IV through XIX.

Table IV

X-Ray Diffraction Pattern of RuTi

| Interplanar Spacing (d) Angstroms | Intensity ($I/I_1$) |
|---|---|
| 3.051 | 30 |
| 2.161 | 100 |
| 1.769 | 10 |
| 1.530 | 40 |
| 1.370 | 10 |
| 1.251 | 70 |
| 1.083 | 30 |
| 1.022 | 10 |
| 0.970 | 60 |
| .925 | 10 |
| .886 | 30 |
| .851 | 10 |
| .8203 | 100 |

Table V

X-Ray Diffraction Pattern of $Rh_3Ti$

| Interplanar Spacing (d) Angstroms | Intensity ($I/I_1$) |
|---|---|
| 3.80 | 5 |
| 2.680 | 5 |
| 2.188 | 100 |
| 1.906 | 90 |
| 1.699 | 5 |
| 1.555 | 10 |
| 1.350 | 50 |
| 1.273 | 10 |
| 1.206 | 5 |
| 1.151 | 90 |
| 1.100 | 60 |
| 1.059 | 5 |
| 1.021 | 5 |
| 0.955 | 60 |
| .927 | 5 |
| .901 | 5 |
| .8768 | 70 |
| .8545 | 50 |
| .8335 | 5 |
| .8146 | 5 |
| .7801 | 90 |

Table VI

X-Ray Diffraction Pattern of $Pt_3Ti$

| Interplanar Spacing (d) Angstroms | Intensity ($I/I_1$) |
|---|---|
| 3.87 | 10 |
| 2.743 | 20 |
| 2.244 | 100 |
| 1.946 | 70 |
| 1.742 | 15 |
| 1.591 | 15 |
| 1.379 | 90 |
| 1.300 | 15 |
| 1.235 | 10 |
| 1.177 | 80 |
| 1.127 | 70 |
| 1.084 | 5 |
| 1.043 | 15 |
| 0.976 | 40 |
| .946 | 10 |
| .919 | 5 |
| .896 | 100 |
| .8732 | 70 |
| .8519 | 5 |
| .8327 | 15 |
| .7973 | 100 |
| .7810 | 5 |

Table VII

X-Ray Diffraction Pattern of $Ir_3Ti$

| Interplanar Spacing (d) Angstroms | Intensity ($I/I_1$) |
|---|---|
| 3.80 | 15 |
| 2.695 | 5 |
| 2.208 | 100 |
| 1.915 | 80 |
| 1.713 | 10 |
| 1.567 | 5 |
| 1.355 | 80 |
| 1.279 | 10 |
| 1.212 | 5 |
| 1.157 | 100 |
| 1.107 | 40 |
| 1.060 | 5 |
| 1.027 | 10 |
| 0.961 | 30 |
| .932 | 10 |
| .906 | 5 |
| .8817 | 100 |
| .8595 | 100 |
| .8387 | 15 |
| .8195 | 5 |
| .7848 | 100 |

Table VIII

X-Ray Diffraction Pattern of RuZr

| Interplanar Spacing (d) Angstroms | Intensity ($I/I_1$) |
|---|---|
| 2.288 | 100 |
| 1.619 | 40 |
| 1.324 | 70 |
| 1.148 | 40 |
| 1.026 | 60 |
| 0.938 | 20 |
| .869 | 100 |
| .813 | 30 |

Table IX

X-Ray Diffraction Pattern of $Rh_3Zr$

| Interplanar Spacing (d) Angstroms | Intensity ($I/I_1$) |
|---|---|
| 2.245 | 100 |
| 1.947 | 70 |
| 1.383 | 80 |
| 1.181 | 90 |
| 1.130 | 40 |
| 0.980 | 30 |
| .900 | 100 |
| .977 | 100 |
| .8013 | 100 |

Table X

X-Ray Diffraction Pattern of OsZr

| Interplanar Spacing (d) Angstroms | Intensity ($I/I_1$) |
|---|---|
| 3.229 | 20 |
| 2.292 | 100 |
| 1.875 | 10 |
| 1.626 | 40 |
| 1.455 | 20 |
| 1.329 | 80 |
| 1.152 | 40 |
| 1.087 | 10 |
| 1.031 | 70 |
| 0.982 | 10 |
| .941 | 30 |
| .904 | 10 |
| .872 | 100 |
| .8155 | 40 |
| .7912 | 50 |

Table XI

X-Ray Diffraction Pattern of $Rh_3V$

| Interplanar Spacing (d) Angstroms | Intensity ($I/I_1$) |
|---|---|
| 3.75 | 5 |
| 2.672 | 5 |
| 2.175 | 100 |
| 1.887 | 80 |
| 1.689 | 10 |
| 1.541 | 5 |
| 1.338 | 90 |
| 1.260 | 10 |
| 1.192 | 5 |
| 1.143 | 100 |
| 1.091 | 50 |
| 1.047 | 5 |
| 1.009 | 5 |
| 0.947 | 40 |
| .919 | 5 |
| .893 | 10 |
| .8703 | 100 |
| .8483 | 100 |
| .8278 | 5 |
| .8089 | 5 |

Table XI-continued

X-Ray Diffraction Pattern of $Rh_3V$

| Interplanar Spacing (d) Angstroms | Intensity ($I/I_1$) |
|---|---|
| .7746 | 100 |

Table XII

X-Ray Diffraction Pattern of RuV

| Interplanar Spacing (d) Angstroms | Intensity ($I/I_1$) |
|---|---|
| 2.985 | 30 |
| 2.115 | 100 |
| 1.729 | 20 |
| 1.498 | 60 |
| 1.341 | 30 |
| 1.224 | 80 |
| 1.060 | 50 |
| 1.000 | 30 |
| 0.949 | 80 |
| .905 | 10 |
| .866 | 40 |
| .832 | 20 |
| .8022 | >100 |

Table XIII

X-Ray Diffraction Pattern of OsV

| Interplanar Spacing (d) Angstroms | Intensity ($I/I_1$) |
|---|---|
| 2.992 | 50 |
| 2.121 | 100 |
| 1.733 | 30 |
| 1.502 | 50 |
| 1.345 | 40 |
| 1.228 | 80 |
| 1.063 | 40 |
| 1.002 | 30 |
| 0.952 | 60 |
| .907 | 30 |
| .868 | 40 |
| .834 | 30 |
| .8044 | 100 |

Table XIV

X-Ray Diffraction Pattern of $Ir_3V$

| Interplanar Spacing (d) Angstroms | Intensity ($I/I_1$) |
|---|---|
| 3.74 | 15 |
| 2.670 | 15 |
| 2.182 | 100 |
| 1.896 | 90 |
| 1.694 | 15 |
| 1.550 | 15 |
| 1.342 | 90 |
| 1.268 | 15 |
| 1.202 | 10 |
| 1.147 | 100 |
| 1.108 | 40 |
| 1.055 | 5 |
| 1.015 | 10 |
| 0.951 | 30 |
| .923 | 5 |
| .897 | 10 |
| .873 | 100 |
| .8514 | 100 |
| .8315 | 10 |
| .8123 | 10 |
| .7780 | 100 |

Table XV

X-Ray Diffraction Pattern of $Ir_3Nb$

| Interplanar Spacing (d) Angstroms | Intensity ($I/I_1$) |
|---|---|
| 3.83 | 10 |
| 2.743 | 10 |
| 2.238 | 100 |
| 1.940 | 80 |
| 1.736 | 10 |
| 1.584 | 10 |
| 1.371 | 90 |
| 1.294 | 10 |
| 1.228 | 5 |
| 1.170 | 100 |
| 1.121 | 50 |
| 1.077 | 5 |
| 1.038 | 10 |
| 0.972 | 40 |
| .944 | 5 |
| .917 | 5 |
| .893 | 80 |
| .8699 | 90 |
| .8493 | 5 |
| .8298 | 15 |
| .7946 | 100 |

Table XVI

X-Ray Diffraction Pattern of $Ir_3Ta$

| Interplanar Spacing (d) Angstroms | Intensity ($I/I_1$) |
|---|---|
| 2.24 | 100 |
| 1.938 | 90 |
| 1.371 | 90 |
| 1.170 | 100 |
| 1.121 | 40 |
| 0.971 | 30 |
| .892 | 100 |
| .8690 | 100 |
| .7935 | 100 |

Table XVII

X-Ray Diffraction Pattern of $Cr_3Rh$

| Interplanar Spacing (d) Angstroms | Intensity ($I/I_1$) |
|---|---|
| 3.30 | 25 |
| 2.337 | 55 |
| 2.090 | 80 |
| 1.909 | 100 |
| 1.652 | 4 |
| 1.478 | 4 |
| 1.349 | 4 |
| 1.296 | 18 |
| 1.249 | 40 |
| 1.168 | 14 |
| 1.102 | 2 |
| 1.045 | 10 |
| 1.020 | 10 |
| 0.996 | 10 |
| .954 | 2 |
| .917 | 2 |
| .868 | 12 |
| .853 | 14 |
| .826 | 10 |
| .802 | 2 |

Table XVIII

X-Ray Diffraction Pattern of $PtCr_2$

| Interplanar Spacing (d) Angstroms | Intensity ($I/I_1$) |
|---|---|
| 2.67 | 70 |
| 2.185 | 100 |
| 1.896 | 80 |
| 1.698 | 40 |
| 1.549 | 10 |
| 1.343 | 100 |

Table XVIII-continued

X-Ray Diffraction Pattern of $PtCr_2$

| Interplanar Spacing (d) Angstroms | Intensity ($I/I_1$) |
|---|---|
| 1.260 | 40 |

Table XIX

X-Ray Diffraction Pattern of $Cr_3Ir$

| Interplanar Spacing (d) Angstroms | Intensity ($I/I_1$) |
|---|---|
| 3.309 | 80 |
| 2.3404 | 55 |
| 2.0937 | 55 |
| 1.9106 | 100 |
| 1.6554 | 10 |
| 1.4805 | 12 |
| 1.2978 | 6 |
| 1.2506 | 45 |
| 1.1700 | 10 |
| 1.1031 | 8 |
| 1.0466 | 12 |
| 1.0216 | 4 |
| 0.9979 | 12 |
| .9556 | 4 |
| .9180 | 10 |
| .8693 | 4 |
| .8546 | 14 |
| .8275 | 8 |
| .8028 | 6 |

Table IV shows the data for RuTi reported in A.S.T.M., X-Ray Powder Diffraction File, Card 18–1144. Table V shows the data of Downey, Met. Div. Argonne Nat. Lab., Argonne, Ill. (1964) and of Dwight and Beck, Trans. AIME, 215, 976 (1959), reproduced in A.S.T.M., X-Ray Powder Diffraction File, Card 17–50, for $Rh_3Ti$. Table VI shows the data for $Pt_3Ti$ and Table VII shows the data for $Ir_3Ti$, reported by Downey, Met. Div., Argonne Nat. Lab., Argonne, Ill., (1964) and by Dwight and Beck, Trans. AIME, 215, 976 (1959), reproduced in A.S.T.M., X-Ray Powder Diffraction File, Cards 17–64 ($Pt_3Ti$) and 17–37 ($Ir_3Ti$). Table VIII shows the data reported in A.S.T.M., X-Ray Powder Diffraction File, Card 18–1147, for RuZr. Table IX shows the data of Downey, op cit, and of Dwight and Beck, op cit, for $Rh_3Zr$, reproduced in A.S.T.M., X-Ray Powder Diffraction File, Card 17–49. Table X shows the data for OsZr reported in A.S.T.M., X-Ray Powder Diffraction File, Card 18–949. Table XI shows the data of Downey, op cit, and of Dwight and Beck, op cit, for $Rh_3V$, reproduced in A.S.T.M., X-Ray Powder Diffraction File, Card 17–63. Table XII shows the data for RuV reported in A.S.T.M., X-Ray Powder Diffraction File, Card 19–1111. Table XIII shows the data for OsV reported in A.S.T.M., X-Ray Powder Diffraction File, Card 18–1947. Table XIV shows the data of Downey, op cit, and Dwight and Beck, op cit, for $Ir_3V$, reported in A.S.T.M., X-Ray Powder Diffraction Files, Card 17–38. Table XV shows the data of Downey, op cit, and of Dwight and Beck, op cit, for $Ir_3Nb$, reported in A.S.T.M., X-Ray Powder Diffraction Files, Card 17–35. Table XVI shows the data of Downey, op cit, and of Dwight and Beck, op cit, for $Ir_3Ta$, reported in A.S.T.M., X-Ray Powder Diffraction Files, Card 17–36. Table XVII shows the data of Monograph 25, Section 6, 15, National Bureau of Standards (1968), for $Cr_3Rh$, reported in A.S.T.M., X-Ray Powder Diffraction Files, Card 20–314. Table XVIII shows the data of Greenfield and Beck, J. Metals (Feb.) 265 (1956), for $PtCr_2$, reproduced in A.S.T.M., X-Ray Powder Diffraction Files, Card 8–340. Table XIX shows the data of Monograph 25, Sec. 6, National Bureau of Standards (1968), for $Cr_3Ir$, reported in A.S.T.M., X-Ray Powder Diffraction File, Card 18–385.

Three other molybdenum compounds in addition to $Mo_5Ru_3$and $Mo_3Ir$ that are useful in providing the electrode material of this invention are $Pt_3Mo$, $Mo_{19.5}Os_{10.5}$, and MoRe. Table XX shows the data of Rooksby and Lewis, J. Less Common Metals 6, 451–60 (1964), reproduced in A.S.T.M., X-Ray Powder Diffraction File, Card 17–719, for $Pt_3Mo$. Table XXI shows the data of Spooner and Wilson, Acta Cryst., 17, 12, 1533–38, reproduced in A.S.T.M., X-Ray Powder Diffraction File, Card 18–843, for $Mo_{19.5}Os_{10.5}$. Table XXII shows the data of Tylkina et al, Proc. Acad. Sci., U.S.S.R., 131, 247, reproduced in A.S.T.M., X-Ray Powder Diffraction File, Card 15–116, for MoRe.

Table XX

X-Ray Diffraction Pattern of $Pt_3Mo$

| Interplanar Spacing (d) Angstroms | Intensity ($I/I_1$) |
|---|---|
| 3.85 | 5 |
| 2.580 | 15 |
| 2.257 | 100 |
| 1.968 | 15 |
| 1.949 | 35 |
| 1.575 | 10 |
| 1.525 | 10 |
| 1.385 | 50 |
| 1.378 | 50 |
| 1.308 | 5 |
| 1.285 | 15 |
| 1.185 | 25 |
| 1.176 | 60 |
| 1.129 | 35 |
| 1.088 | 5 |
| 1.062 | 5 |
| 0.990 | 5 |
| .984 | 10 |
| .974 | 20 |
| .898 | 70 |
| .895 | 30 |
| .878 | 20 |
| .873 | 40 |
| .871 | 40 |
| .828 | 10 |
| .821 | 10 |
| .801 | 15 |
| .797 | 30 |
| .777 | 10 |

Table XXI

X-Ray Diffraction Pattern of $Mo_{19.5}Os_{10.5}$

| Interplanar Spacing (d) Angstroms | Intensity ($I/I_1$) |
|---|---|
| 4.40 | 20 |
| 4.30 | 4 |
| 4.00 | 6 |
| 3.40 | 2 |
| 3.24 | 2 |
| 2.677 | 4 |
| 2.470 | 25 |
| 2.327 | 85 |
| 2.266 | 35 |
| 2.197 | 25 |
| 2.145 | 65 |
| 2.109 | 100 |
| 2.060 | 60 |
| 1.999 | 10 |
| 1.920 | 16 |
| 1.812 | 8 |
| 1.792 | 8 |
| 1.762 | 10 |
| 1.723 | 2 |
| 1.696 | 4 |

Table XXI-continued

X-Ray Diffraction Pattern of $Mo_{19.5}Os_{10.5}$

| Interplanar Spacing (d) Angstroms | Intensity ($I/I_1$) |
|---|---|
| 1.679 | 4 |
| 1.633 | 4 |
| 1.499 | 2 |
| 1.447 | 4 |
| 1.371 | 16 |
| 1.360 | 8 |
| 1.345 | 30 |
| 1.332 | 20 |

Table XXII

X-Ray Diffraction Pattern of MoRe

| Interplanar Spacing (d) Angstroms | Intensity ($I/I_1$) |
|---|---|
| 2.308 | 100 |
| 2.247 | 75 |
| 2.202 | 25 |
| 2.142 | 50 |
| 2.097 | 100 |
| 2.044 | 75 |

The preferred intermetallic compositions useful in providing anodes and carrying out electrochemical processes in electrolytic cells are high melting point compositions having a melting point range of from about 700° C to about 2600° C, most frequently in the range of from about 1000° C to about 2000° C for compositions of titanium, in the range of about 700° C to about 1600° C for compositions of vanadium, in the range of about 1200° C to about 2000° C for compositions of chromium, in the range of about 1000° C to about 2200° C for compositions of zirconium, in the range of about 1100° C to about 2000° C for compositions of columbium, in the range of about 1300° C to about 2600° C for compositions of molybdenum, in the range of about 1800° C to about 2600° C for compositions of tantalum, in the range of about 1800° C to about 2600° C for compositions of tungsten, and in the range of about 1100° C to about 1600° C for compositions of manganese.

Additionally, the preferred intermetallic compositions of platinum group metals and transition metals have a bulk electrical conductivity of from about $10^{-1}$ (ohm-centimeters)$^{-1}$ to about $10^{-6}$ (ohm-centimeters)$^{-1}$.

A preferred category of the intermetallic compositions of platinum group metals and transition metals are those characterized by a low, steady state chlorine overvoltage, i.e., by a chlorine overvoltage of less than 0.30 volts (300 millivolts) after the transients have approached zero. Typically, steady state is attained at a time of from about several minutes after commencing the test for 3 or 4 days after commencing tests. The chlorine overvoltage is determined as follows:

A two-compartment cell constructed of polytetrafluoroethylene with a diaphragm composed of asbestos paper is used in the measurement of chlorine overpotentials. A stream of water-saturated $Cl_2$ gas is dispersed into a vessel containing saturated NaCl, and the resulting $Cl_2$-saturated brine is continuously pumped into the anode chamber of the cell. In normal operation, the temperature of the electrolyte ranges from 30° to 35° C, most commonly 32° C, at a pH of 4.0. A platinized titanium cathode is used.

In operation, an anode is mounted to a titanium holder by means of titanium bar clamps. Two electrical leads are attached to the anode; one of these carries the applied current between anode and cathode at the voltage required to cause continuous generation of chlorine. The second is connected to one input of a high impedance voltmeter. A Luggin tip made of glass is brought up to the anode surface. This communicates via a salt bridge filled with anolyte with a saturated calomel half cell. Usually employed is a Beckman miniature fiber junction calomel such as catalog No. 39270, but any equivalent one would be satisfactory. The lead from the calomel cell is attached to the second input of the voltmeter and the potential read.

Calculation of the overvoltage, $\eta$, is as follows:

The International Union of Pure and Applied Chemistry sign convention is used, and the Nernst equation taken in the following form:

$$E = E_o + \frac{2.303\ RT}{nF} \log \frac{[\text{oxidized}]}{[\text{reduced}]}$$

Concentrations are used for the terms in brackets instead of the more correct activities.

$E_0$ = the standard state reversible potential = +1.35 volts $n$ = number of electrons equivalent $^{-1}$ = 1

R, gas constant, = 8.314 joule deg$^{-1}$ mole$^{-1}$

F, the Faraday = 96,500 couloumbs equivalent$^{-1}$ $Cl_2$ concentration = 1 atm $Cl^-$ concentration = 5.4 equivalent liter$^{-1}$ (equivalent to 305 grams NaCl per liter)

T = 305° K

For the reaction $$Cl \rightarrow \tfrac{1}{2} Cl_2 + e^-,$$

$$E = 1.35 + 0.060 \log 1/5.4 = 1.30$$

This is the reversible potential for the system at the operating conditions. The overvoltage on the normal hydrogen scale is, therefore, $$\eta = V - [E - 0.24]$$

where V is the measured voltage, E is the reversible potential (1.30 volts) and 0.24 volt is the potential of the saturated calomel half cell.

According to a preferred exemplification of this invention, the electrode has the active electrocatalytic surface made up of the intermetallic composition of the platinum group metal and the transition metal. The surface may consist essentially of the preferred intermetallic compounds or the surface may comprise the intermetallic compound admixed with refractory materials as $TiO_2$, $ZrO_2$, and the like, in which case the surface may contain from about five to about ninety-five weight percent of the intermetallic composition and balance refractory material. Alternatively, the intermetallic composition of the platinum group metal and the transition metal may be provided on the surface of the substrate and a further catalytic material such as a surface catalyst, or an electrocatalyst, or both, may be on the exterior of the electrode. In such a case, the intermetallic compositions herein contemplated serve as an electroconductive sheet or shield or sheath for the substrate, allowing the use of copper, aluminum, iron, or steel substrates for anodes.

In such a case, the catalytic surface atop the intermetallic compositions herein contemplated may be provided by surface catalysts such as spinels, perovskites, bronze oxides, and the like. Alternatively, the material may be provided by various oxides and oxygen-containing compounds of the platinum group metals such as calcium ruthenate, calcium rhodate, strontium ruthenate, strontium rhodate, pyrochlores, delafossites, and mixtures thereof.

The substrate is characterized by an electrical conductivity sufficient to allow its economical use in an electrolytic cell, generally in excess of 100 (ohm-centimeters)$^{-1}$ and preferably in excess of 1000 (ohm-centimeters)$^{-1}$. The substrate may be graphite. Alternatively, the substrate may be a valve metal. By "valve metals" are meant those metals which form an electrically insulating, corrosion resistant film upon exposure to acidic media under anodic conditions. The valve metals include titanium, zirconium, hafnium, vanadium, columbium, tantalum, tungsten, alloys thereof and alloys predominant in any of the above-mentioned valve metals. Where the substrate is a valve metal, the platinum group metal may be deposited on the surface thereof and reacted with the substrate to form the compositions herein contemplated at the interface between the platinum group metal and the valve metal. However, care must be taken to form the desired compound and not a high overvoltage compound or a high resistance alloy or compound.

Alternatively, the substrate may be silicon in which case the intermetallic compositions herein contemplated provide an electroconductive, electrocatalytical coating thereon.

Where an intermetallic composition, e.g., a higher overvoltage intermetallic composition, is used as an intermediate layer or coating as herein contemplated, the high overvoltage intermetallic composition may provide an electroconductive film, layer, coating, lamination, or sheet upon a substrate fabricated of material that is susceptible to corrosion by acidic media under anodic conditions. For example, a substrate of iron, steel, copper, or aluminum, may be used with an intermediate layer of an electroconductive corrosion resistant composition such as described herein. In this case, the copper or aluminum or iron or steel core may have a thin coating, for example, as thin as one-one thousandth of an inch ($2.54 \times 10^{-2}$ mm) or less, of the intermetallic compositions herein contemplated. Such a thin coating must be of sufficient thickness to protect the core from the corrosive environment but may still be thin enough to be a low cost method of using inexpensive metals in fabricating chlor-alkali anodes.

Thereafter, an exterior coating or coatings of an electrocatalytic material or materials may be provided atop the intermediate of an intermetallic composition as herein contemplated. Such exterior coating or coatings may be characterized by some porosity, i.e., by a high degree of surface per unit mass whereby both electrocatalytic and surface-catalytic effects may be provided. For example, one particularly desirable anode may be provided by a foraminous or perforate or expanded mesh aluminum substrate having a coating of about one-one thousandth to about one hundredth of an inch thick ($2.54 \times 10^{-2}$ mm to about $2.54 \times 10^{-1}$ mm) thereon of an intermetallic composition of the type described hereinabove, such as a ruthenium molybdenum compound ($Mo_5Ru_3$) or a platinum titanium compound ($Pt_3Ti$) or any of the materials as hereinabove described. Atop the intermediate protective layer of the intermetallic composition of the platinum group metal and the transition metal is a further coating, for example, a ruthenium dioxide-titanium dioxide composition, or a delafossite, or a pyrochlore, or an intermetallic composition of a platinum group metal and a transition metal, characterized by a low overvoltage.

According to another exemplification of this invention, a suitable anode for chlor-alkali electrolysis may be provided by a foraminous or perforate or mesh or rod-like titanium substrate having as its electrolytic surface a thin surface, e.g., of from about one-one thousandth of an inch to about one-one hundredth of an inch ($2.54 \times 10^{-2}$ mm to about $2.54 \times 10^{-1}$ mm) thick of an intermetallic composition of the type herein contemplated such as $Pt_3Mo$ or $Ru_3Mo_5$ or PdTa or $Pt_3Ti$ or $Mo_3Ir$ or MoRe.

The anodes prepared according to this invention may be used in electrolytic cells, for example, diaphragm cells or mercury cells for the production of chlorine or chlorate cells. A typical diaphragm cell for the production of chlorine would include an anode of the type herein contemplated, having a layer or surface of an intermetallic composition of a platinum group metal and a transition metal on a suitable electroconductive substrate as the anode, a suitable cathode, for example, an iron mesh or steel mesh cathode, and a diaphragm therebetween, for example, an asbestos diaphragm deposited on the cathode or an asbestos paper diaphragm between the anode and the cathode, or even a permionic membrane interposed between the anode and the cathode.

In such a diaphragm cell, brine is fed to the anolyte chamber of the cell and an electrical current is caused to pass from the anode of the cell through the electrolyte to the cathode of the cell, evolving chlorine on the anodes and hydrogen on the cathodes. Within a diaphragm cell, chlorine is recovered from the anolyte chamber and hydrogen gas is recovered from the catholyte chamber. Where the diaphragm is an electrolyte permeable diaphragm, a cell liquor of sodium chloride and sodium hydroxide is recovered from the catholyte chamber. In an electrolytic cell where a permionic membrane is interposed between the anolyte chamber and catholyte chamber, a catholyte liquor consisting essentially of aqueous sodium hydroxide is recovered. While the process of diaphragm cell has been described with reference to sodium chloride brines, it is to be understood that potassium chloride brines may also be electrolyzed with the anodes herein described.

Additionally, the anodes of the type herein contemplated may be used in mercury cells. Mercury cells are characterized by a downward sloping electroconductive surface having a thin film of mercury flowing thereon. The electrolyte, e.g., brine, flows atop the mercury surface with the anodes extending downwardly into the electrolyte and spaced from the mercury surface. Within a mercury cell, chlorine is evolved on the anodes and sodium or potassium metal is amalgamated with the mercury. The mercury is recovered from the cell and transferred to a de-nuder where the mercury sodium or mercury potassium amalgam is contacted with water whereby to evolve an alkali metal hydroxide such as sodium hydroxide or potassium hydroxide.

The details of the invention herein contemplated may be understood by reference to the following illustrative Examples.

EXAMPLE I

A triplatinum molybdenum ($Pt_3Mo$) anode was prepared and tested.

The intermetallic composition of platinum and molybdenum was prepared by grinding 1.3250 grams of Engelhard 24 gauge platinum sheet and 0.2175 grams of 0.00015 inch ($3.81 \times 10^{-6}$ m) molybdenum sheet in a Mullite (R) mortar and pestle. The ground platinum and molybdenum were pressed into pellets in a one-half inch diameter (1.27 cm. diameter) pan pellet press. The pellets were then inserted in suitable mold for fusion. The fusion mold was prepared from an 8 inch by 8 inch by 2 inch (20.4 cm. by 20.4 cm. by 5.08 cm.) graphite block by drilling four cups 1 inch in diameter by ⅝ inch deep (2.54 cm. diameter by 1.59 cm. deep) in the graphite block. The pellets were then placed in the cup and melted using a tungsten electrode arc welder under an Argon atmosphere. Fusion occurred at a current of 75 amperes within 2 to 3 seconds and the current was continued from 3 to 5 seconds after fusion.

The resulting metal alloy beads were tested for electrical conductivity and overvoltage in aqueous sodium chloride solution. This was accomplished by fastening two copper wires to the back of the $Pt_3Mo$ bead using an epoxy resin loaded with silver. This assembly was cast in Quick-Set (R) plastic. The face of the plastic bead was ground to expose the alloy bead. The alloy bead was polished and the copper wires were sheathed in Teflon (R) tubing. The side of the assembly away from the $Pt_3Mo$ bead, where the copper tubing entered the plastic, was set using Silastic (R) cement.

The resulting assembly was then tested as an anode. Chlorine was seen to be evolved and no corrosion was observed.

EXAMPLE II

A ruthenium molybdenum alloy having the formula $Ru_3Mo_5$ was prepared and tested as an anode.

The $Ru_3Mo_5$ alloy was prepared from 0.9096 grams of 60 mesh Alpha Inorganics ruthenium powder and 1.4379 grams of Cerac 2–4 molybdenum powder.

The ruthenium powder and molybdenum powder were ground together in a Mullite mortar and pestle. The resulting ground powder was then pressed into pellets in a one-half inch diameter (1.27 cm. diameter) pan pellet press. The pellets were then placed in a graphite block as described in Example I hereinabove. The pellets were then arc melted using a tungsten electrode arc welder under an Argon atmosphere. The welding current was 150 amperes for 2 to 3 seconds until fusion was obtained and then an additional 3 to 5 seconds.

The resulting $Ru_3Mo_5$ bead was tested for electrical conductivity and overvoltage in an aqueous sodium chloride solution under anodic conditions. Two copper wires were fastened to the back of the bead using silver loaded epoxy resin. The assembly of the bead and copper wires was then cast in Quick-Set (R) plastic. The face of the assembly was ground down to expose the $Ru_3Mo_5$ alloy bead and the alloy bead was polished. The copper wires were sheathed in Teflon (R) tubing and Silastic (R) cement as described hereinabove.

The alloy was tested as an electrode in aqueous sodium chloride solution and chlorine gas was seen to be evolved. No corrosion was observed and the overvoltage was found to be 0.11 volts at a current density of 200 amperes per square foot.

EXAMPLE III

A palladium tantalum alloy, PdTa, was prepared and tested as an anode for a chlorine evolution.

The PdTa alloy was prepared by mixing 0.8512 gram of Engelhard 200 mesh palladium powder and 1.4476 grams of Alpha Inorganics 325 mesh tantalum powder in a mortar and pestle. The palladium and tantalum powders were ground together in a Molite mortar pestle. Thereafter, the mixed palladium and tantalum powders were pressed into pellets in a one-half inch diameter (1.27 cm. diameter) pan pellet press. The resulting pellet was placed in a cup in a graphite block as described in Example I hereinabove. The palladium and tantalum powders in the cup within the graphite block were then arc melted using a tungsten electrode arc under an Argon atmosphere. The arc melting current was 75 amperes and fusion was obtained after 2 to 3 seconds. Power was continued for an additional 3 to 5 seconds.

The resulting PdTa beads were tested for electrical conductivity in aqueous sodium chloride under anodic conditions. In preparing the test assembly, two copper wires were fastened to the back of the PdTa bead using a silver lead of epoxy resin. This assembly was then cast in Quick-Set (R) plastic and the face ground down to expose the alloy bead as described in Example I hereinabove. The alloy bead was thereafter polished and the copper wires sheathed with Teflon (R) tubing. The face where the copper wires entered the plastic was set using Silastic (R) cement as described hereinabove.

This palladium tantalum anode assembly was then tested as an anode in aqueous sodium chloride. Chlorine was seen to be evolved and no corrosion was observed.

EXAMPLE IV

A platinum titanium, $Pt_3Ti$, anode was prepared and tested.

The $Pt_3Ti$ was prepared from 1.2718 grams of Engelhard 24 gauge platinum sheet and 0.1150 grams of 1/16 inch (1.59 mm.) titanium sheet. The platinum sheet and titanium sheet were ground together in a Mullite (R) mortar and pestle. The platinum and titanium were then removed from the mortar and pestle and pressed into pellets in ½ inch diameter (1.27 cm.) pan pellet press.

The pellets were then inserted in cups in a graphite block as described in Example I hereinabove and arc melted using a tungsten electrode arc welder under an Argon atmosphere. The arc melting current was 75 amperes and fusion was obtained in 2 to 3 seconds with an additional 3 to 5 seconds of current.

The resulting $Pt_3Ti$ beads were tested for electrical conductivity in aqueous sodium chloride under anodic conditions. An anode assembly was prepared as described above by fastening two copper wires to the back of the bead using a silver loaded epoxy resin. The assembly was then cast in Quick-Set (R) plastic and the base ground down to expose the alloy. The alloy was polished. The copper wires were then sheathed in Teflon (R) tubing, and the tubing sheath set in Silastic (R) cement where the copper wires entered the anode assembly. The resulting anode assembly was tested as an anode in aqueous sodium chloride. Chlorine bubbles were seen to be evolved and no corrosion was observed.

It is to be understood that although the invention has been described with specific reference to specific details and particular exemplifications and embodiments thereof, it is not to be so limited since changes and alterations therein may be made which are within the full intended scope of this invention as defined by the appended claims.

I claim:

1. An electrode comprising:

an electroconductive substrate; and and electroconductive surface on said substrate consisting essentially of a congruently melting compound chosen from the group consisting of RuTi, RuV, $Ru_2Zr$, NbRu, RuTa, $Mo_5Ru_3$, $W_3Ru_2$, $RuCr_2$, $Rh_3Ti$, $Rh_3V$, $Rh_3Zr$, $Rh_3Nb$, $Rh_3Ta$, $RhCr_3$, OsTi, OsV, OsZr, $Nb_3Os_2$, $Mo_{19.5}Os_{10.5}$, $Ta_3Os$, $WOs_2$, $Cr_2Os$, $TiIr_3$, $VIr_3$, $ZrIr_2$, $Ir_3Nb$, $Mo_3Ir$, $TaIr_3$, HfIrNi, $Cr_3Ir$, $Mn_3Ir$, $Pt_3Ti$, $Pt_3V$, $Pt_3Zr$, $Pt_3Nb$, $Pt_3Mo$, $Pt_4Ta$, $PtCr_2$, $Re_3V$, $Re_2Zr$, NbRe, MoRe, TaRe, WRe, $Re_3Fe_2$, CrRe, $Mn_3Re_2$, $TiPd_3$, $Pd_3V$, $Pd_3Zr$, PdTa, $Pd_3Mn_2$, and mixtures thereof.

2. An electrode comprising:

an electroconductive substrate; and an electroconductive surface on said substrate consisting essentially of a compound chosen from the group consisting of RuTi, RuV, $Ru_2Zr$, NbRu, RuTa, $Mo_5Ru_3$, $W_3Ru_2$, $RuCr_2$, $Rh_3Ti$, $Rh_3V$, $Rh_3Zr$, $Rh_3Nb$, $Rh_3Ta$, $RhCr_3$, OsTi, OsV, OsZr, $Nb_3Os_2$, $Mo_{19.5}Os_{10.5}$, $Ta_3Os$, $WOs_2$, $Cr_2Os$, $TiIr_3$, $VIr_3$, $ZrIr_2$, $Ir_3Nb$, $Mo_3Ir$, $TaIr_3$, HfIrNi, $Cr_3Ir$, $Mn_3Ir$, $Pt_3Ti$, $Pt_3V$, $Pt_3Zr$, $Pt_3Nb$, $Pt_4Ta$, $PtCr_2$, $Re_3V$, $Re_2Zr$, NbRe, MoRe, TaRe, WRe, $Re_3Fe_2$, CrRe, $Mn_3Re_2$, $TiPd_3$, $Pd_3V$, $Pd_3Zr$, PdTa, $Pd_3Mn_2$, and mixtures thereof.

* * * * *

UNITED STATES PATENT OFFICE

CERTIFICATE OF CORRECTION

PATENT NO. : 4,007,107

DATED : February 8, 1977

INVENTOR(S) : Harlan B. Johnson

It is certified that error appears in the above-identified patent and that said Letters Patent are hereby corrected as shown below:

Column 18, line 49, after "$Pt_3Nb$," please add --$Pt_3Mo$,--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*